US006644608B1

(12) United States Patent
Begg

(10) Patent No.: US 6,644,608 B1
(45) Date of Patent: Nov. 11, 2003

(54) EYEGLASS DISPLAY CLIP

(75) Inventor: Robert G. Begg, Maple Ridge (CA)

(73) Assignee: 20/20 Marketing Ltd., British Columbia (CA)

( * ) Notice: Subject to any disclaimer, the term of this patent is extended or adjusted under 35 U.S.C. 154(b) by 0 days.

(21) Appl. No.: 10/259,913

(22) Filed: Sep. 30, 2002

(51) Int. Cl.[7] ..... A47B 96/06
(52) U.S. Cl. ..... 248/229.16; 248/902
(58) Field of Search ..... 248/902, 229.16, 248/227.3, 227.4, 230.7, 231.81; 211/85.1, 13

(56) References Cited

U.S. PATENT DOCUMENTS

| | | | | | |
|---|---|---|---|---|---|
| 2,930,567 | A | * | 3/1960 | Lloyd-Young | 248/309.1 |
| 3,552,701 | A | * | 1/1971 | Montagano | 248/316.8 |
| D250,560 | S | * | 12/1978 | Gordon | D6/570 |
| 4,150,752 | A | * | 4/1979 | Breining et al. | 211/85.1 |
| 4,558,788 | A | * | 12/1985 | Grothaus | 211/85.1 |
| 4,787,520 | A | | 11/1988 | Pearson | |
| 4,890,745 | A | | 1/1990 | Holden | |
| 4,944,582 | A | * | 7/1990 | Zancaner | 351/41 |
| 5,069,416 | A | | 12/1991 | Ennis | |
| 5,137,242 | A | * | 8/1992 | Reath | 248/309.1 |
| 5,176,262 | A | | 1/1993 | Zoueki | |
| 5,265,736 | A | | 11/1993 | Orr | |
| 5,316,252 | A | | 5/1994 | Charnow et al. | |
| D369,039 | S | | 4/1996 | Guccione | |
| 5,593,045 | A | | 1/1997 | Eldon, III et al. | |
| D402,827 | S | * | 12/1998 | Ennis | D6/466 |
| D406,714 | S | * | 3/1999 | Eldon et al. | D6/567 |
| 5,921,409 | A | | 7/1999 | Gerber et al. | |
| D417,566 | S | * | 12/1999 | Baldwin et al. | D6/462 |
| 6,102,346 | A | * | 8/2000 | Visser | 248/200 |
| 6,273,386 | B1 | * | 8/2001 | Boeder | 248/309.1 |
| D462,166 | S | * | 9/2002 | Chan | D3/219 |
| 6,443,317 | B1 | * | 9/2002 | Brozak, Jr. | 211/85.1 |

* cited by examiner

*Primary Examiner*—Leslie A. Braun
*Assistant Examiner*—A. Joseph Wujciak, III
(74) *Attorney, Agent, or Firm*—Robert L. Epstein; Harold James; James & Franklin, LLP

(57) ABSTRACT

The clip includes spaced hollow members each defining a channel adapted to receive the temple piece of an eyeglass frame. It also includes first and second inclined elements to support the bridge of the eyeglasses. A rod is engaged between the members. The rod may be provided with a stand for display on a surface or may be used with brackets attached to a flat or slotted wall.

32 Claims, 3 Drawing Sheets

EYEGLASS DISPLAY CLIP

CROSS-REFERENCE TO RELATED APPLICATIONS

"Not Applicable"

STATEMENT REGARDING FEDERALLY SPONSORED RESEARCH OR DEVELOPMENT

"Not Applicable"

INCORPORATION BY-REFERENCE OF MATERIAL SUBMITTED ON A COMPACT DISC

"Not Applicable"

REFERENCE TO A "MICROFICHE APPENDIX

"Not Applicable"

BACKGROUND OF THE INVENTION (1) Field of the Invention

The present invention relates to eyeglass display devices and more particularly to a clip for displaying eyeglasses of a variety of different sizes, in several different manners, on a stand or mounted on a wall.

(2) Decription of Related Art including information disclosed under 37 CFR 1.97 and 1.98

Retail commercial eyewear display devices are commonly used and take many different forms. Some, such as that enclosed in U.S. Pat. No. 4,787,520 issued Nov. 29, 1988 to Robert C. Pearson, entitled "Article Display" provide a tray which receives the lens supporting frame sections of the eyeglasses. Others, such as disclosed in U.S. Pat. No. 5,265,736 issued Nov. 30, 1993 to Tom Orr, entitled "Apparatus for Displaying Eyeglass Frames" include a channel into which the ends of the eyeglasses temple pieces are received. U.S. Pat. No. 5,921,409 issued to William Gerber on Jul. 13, 1999, entitled "Eye Wear Display Device And Method Of Using Same" teaches a device that receives the ends of the temple pieces in a "V" shaped member defining a pair of recesses.

Other types of displays engage and/or support the bridge of the eyeglass frame. See, for example, U.S. Pat. No. 5,316,252 entitled "Unique Eyeglass Holder for Displays" issued May 31, 1994 to Mr. Charnow et al.; U.S. Design Pat. No. Des. 369,039 entitled "Modular Eyeglass Display Stand Unit" issued Apr. 23, 1996 to Michael Guccione; U.S. Pat. No. 5,593,045 entitled "Eyeglass and Eyeglass Frame Display Fixture and System" issued to James Eldon et al. on Jan. 14, 1997; U.S. Pat. No. 5,069,416 entitled "Display Fixture For Spectacles" issued Dec. 3, 1991 to Jan S. Ennis; and U.S. Pat. No. 4,890,745 entitled "Display Holder For Eyeglasses" issued Jan. 2, 1990 to W. Bruce Holden.

Many of these displays are designed to be part of a stand. See U.S. Pat. Nos. 4,890,745; U.S. Pat. No. 5,921,409; U.S. Pat. No. 5,069,416 and U.S. Pat. No. 4,787,520 mentioned above, as well as U.S. Pat. No. 5,176,262 issued Jan. 5, 1993 to G. Zoucki entitled "Display Apparatus" which may include one or more supports, some of which are rods with bases. Others are designed to mount on a wall, such as that disclosed in U.S. Pat. No. 5,593,045 and 5,316,252.

However, none of the know display devices are capable of supporting eyeglasses of a variety of different sizes, both by the bridge and by the temple pieces, in several different manners, on a stand or mounted on a wall. Further, none can achieve this versatility with a simple design that is inexpensive to manufacture.

It is, therefore, a prime object of the present invention to provide an eyeglass display clip which is capable of supporting eyeglasses of a variety of different sizes, both by the bridge and by the temple pieces, in several different manners.

It is another object of the present invention to provide an eyeglass display clip which can support eyeglasses on a freestanding stand or mounted to a wall.

It is another object of the present invention to provide an eyeglass clip which is simple in design and inexpensive to manufacture.

BRIEF SUMMARY OF THE INVENTION

In accordance with one aspect of the present invention, a clip is provided for displaying eyeglasses. The eyeglasses are of the type having lens holding frame sections connected by a bridge and first and second hingeably mounted temple pieces. The clip includes first and second members each defining a channel adapted to receive a different one of the temple pieces. Means are also provided for supporting the bridge of the eyeglasses.

The clip includes a wall with a first side. The first and second members extend outwardly from spaced locations on the first side of the wall. The members may be substantially parallel to each other so as to provide temple piece receiving channels that are parallel to each other or may be tapered so as to provide channels that are inclined towards each other.

The wall has a second side. The bridge supporting means includes first and second elements extending outwardly from the second side of the wall. The first and second elements are inclined relative to each other to form a shape suitable to support the bridge of the eyeglasses.

The bridge supporting means also includes a third element. The third element is mounted on the first and second elements at a location spaced from the second side of the wall. Preferably, the third element is substantially parallel to the second side of the wall and has a generally trapezoidal shape.

The clip is designed to mount on a rod and further comprises rod engaging means. This means is defined by the first and second members and the portion of the first side of the wall situated therebetween. Those parts define a generally cylindrical channel adapted to receive the rod.

The clip further includes a base for the rod such that the rod can stand on a surface. Alternatively, means for mounting the rod to a wall may also be included.

In accordance with another aspect of the present invention, an eyeglass display clip is provided with a wall having first and second sides. First and second members extend outwardly from the first side of the wall. The first and second members each define a channel. First and second elements extend outwardly from the second side of the wall. The first and second elements are inclined relative to each other.

The clip also includes a third element. The third element is mounted on the first and second elements spaced from, but general parallel to, the wall.

The clip is designed to mount on a rod. A rod engaging channel is defined between the first and second members.

BRIEF DESCRIPTION OF THE SEVERAL VIEWS OF THE DRAWINGS

To these and to such other objects which may hereinafter appear, the present invention relates to an eyeglass display clip, as described in detail in the following specification and recited in the annexed claims, taken together with the accompanying drawings, wherein like numerals refer to like parts, and in which:

DETAILED DESCRIPTION OF THE INVENTION

Figure 1:
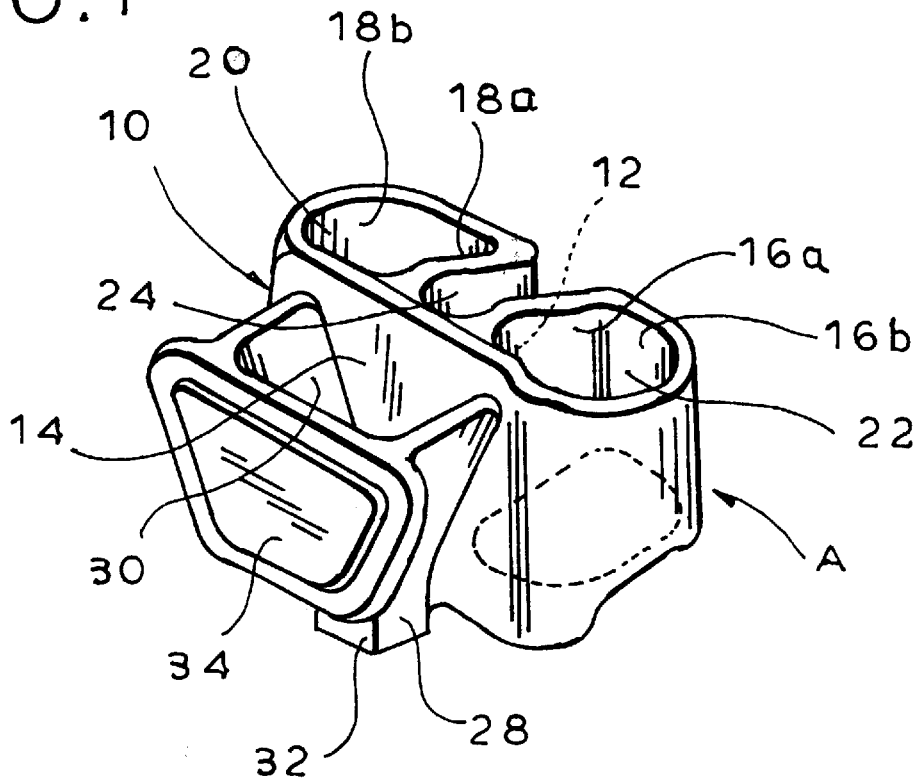
FIG. 1 is an isometric view of the front of a first preferred embodiment of the clip of the present invention.

As seen in the drawings, both preferred embodiments of the clip of the present invention, respectively generally designated A and A', include a generally planar central wall 10. Wall 10 has a first side 12 and a second side 14.

Extending at spaced locations from side 12 of wall 10 are first and second hollow members 16, 18. Each of the members 16, 18 is formed of a generally planar wall 16*a*, 18*a* and a generally semi-circular wall 16*b*, 18*b*, defining first and second generally semi-cylindrical channels. These channels serve as recesses to receive the ends of the temple pieces of the frame of the eyeglasses supported by the clip.

Figure 2:
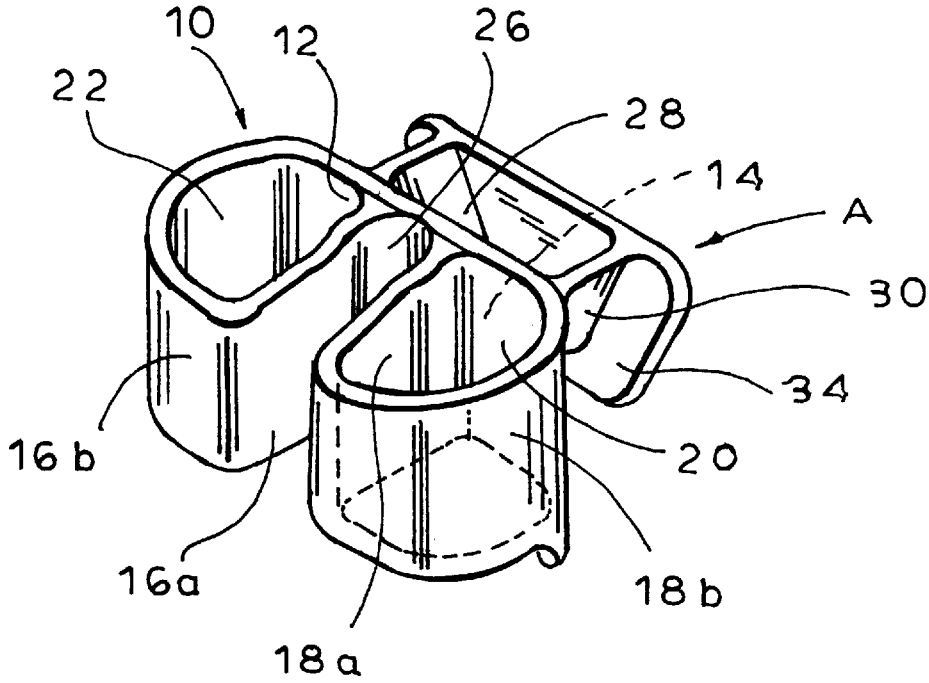
FIG. 2 is an isometric view of the rear of the first preferred embodiment clip of the present invention.
Figure 3:
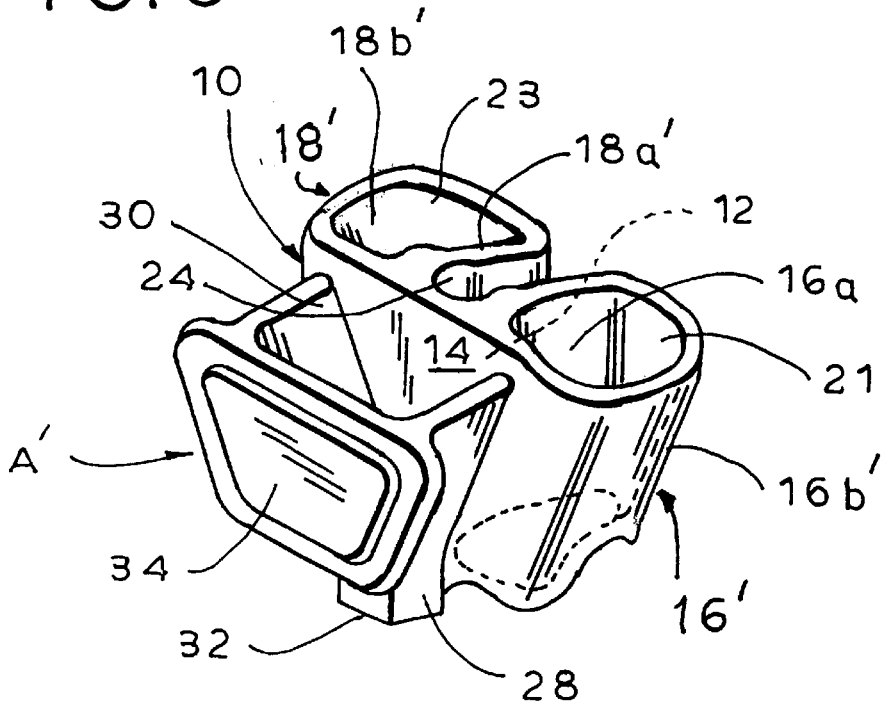
FIG. 3 is an isometric view of the front of a second preferred embodiment of the present invention.
Figure 4:
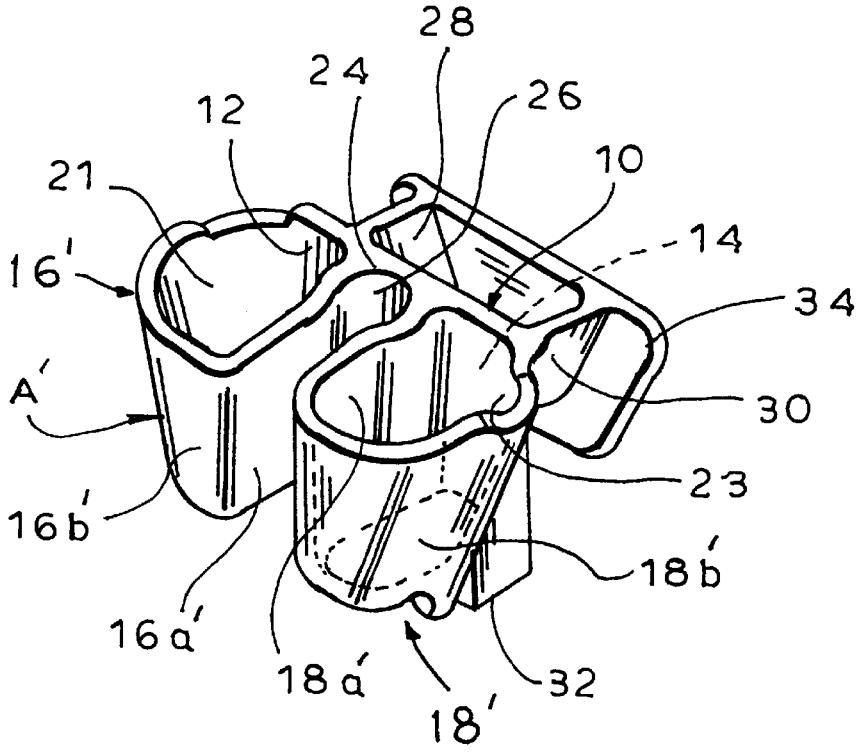
FIG. 4 is an isometric view of the rear of the second preferred embodiment of the present invention.

In the first preferred embodiment of the clip, clip A as shown in FIGS. 1 and 2, members 16 and 18 and thus channels 20, 22, are generally uniform in size and the walls of the channels generally parallel to each other. In the second preferred embodiment of the clip, clip A' as seen in FIGS. 3 and 4, members 16' and 18' are each tapered toward the bottom, such that walls 16*b*' and 18*b*' are inclined towards each other, as are channels 21 and 23.

The portions of members walls 16*a* and 18*a* adjacent side 12 of wall 10, and the portion 24 of side 12 of wall 10 between members 16 and 18, define in part a generally cylindrical channel 26. Channel 26 extends from the top to the bottom of the clip, parallel and adjacent to wall 10 and is designed to receive a rod, as explained below.

Extending at spaced locations from side 14 of wall 10 are first and second generally "L" shaped elements 28, 30. Elements 28 and 30 are inclined with respect to each other so as to form a support for the bridge of the eyeglass frame. A cube-like part 32 is situated between elements 28, 30, at their closest point. Elements 28, 30 and part 32 form a triangular-like structure.

Fixed to the outer edges of elements 28, 30 is generally a planar element 34. Element 34 is spaced from but generally parallel to wall 10. Element 34 preferably has a trapezoidal shape.

Figure 5:
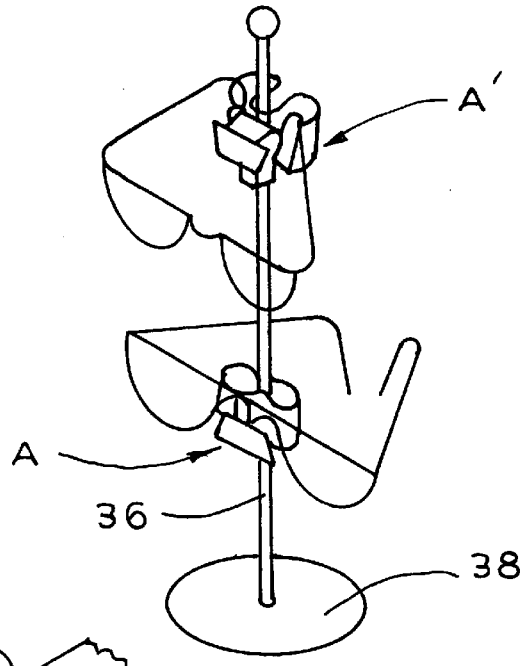
FIG. 5 is an isometric view of two clips of the present invention situated on a stand.
Figure 6:
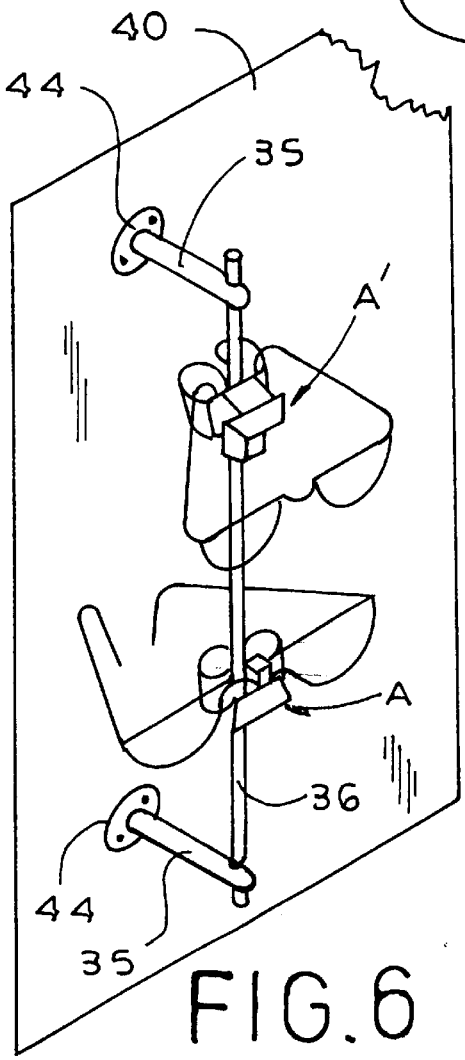
FIG. 6 is an isometric view of the clip mounted on a flat wall.
Figure 7:
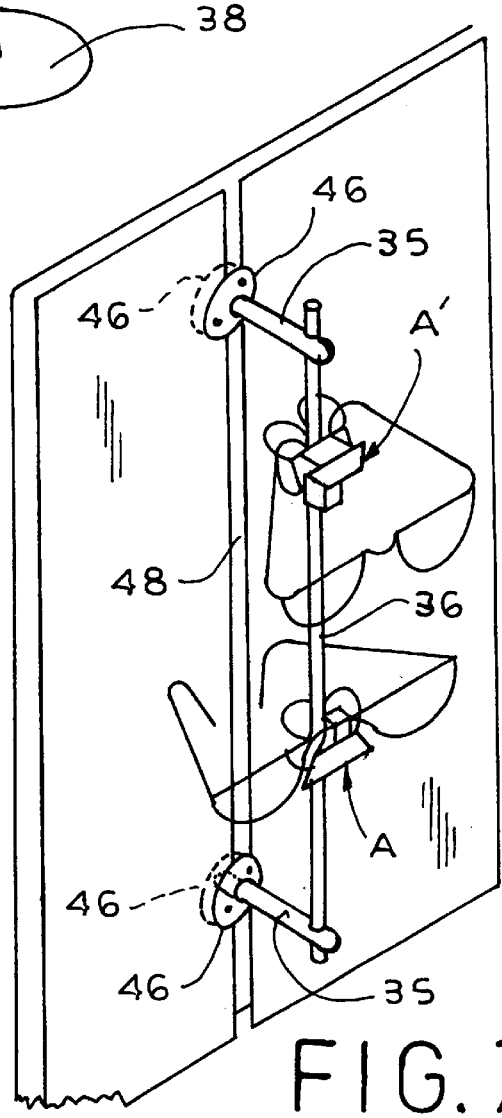
FIG. 7 is an isometric view of the clip mounted on a slotted wall.

The clip is preferably formed of a single piece of injection molded plastic. The plastic has a small amount of resiliency such that the gap between channel walls 16*a* and 18*a* can widen slightly to permit the clip to be "snap-fit" onto a rod 36. Rod 36 is received between members 16 and 18, within channel 26, as seen in FIGS. 5–7. The clip can be oriented in one of two ways on the rod, with part 32 facing up or part 32 facing down, as seen in FIG. 5.

When part 32 is up, as shown by the bottom clip in FIG. 5, elements 28 and 30 form a support for the bridge of an eyeglass frame situated between element 34 and side 14 of wall 10. The hingeably mounted temple pieces can be folded or extended. In either orientation, channels 21 and 23 of clip A' and channels 22 and 20 of clip A are adapted to receive the ends of the temple pieces to support the eyeglasses.

Rod 36 can have a base 38 so as to be freestanding, as shown in FIG. 5. As many different clips as is desired may be snap-fit along the rod, depending upon the length of the rod. This configuration is used for countertop, floor or pedestal displays.

Alternatively, rod 36 can be attached by pairs of brackets 35 to a flat wall 40, as seen in FIG. 6, or slotted wall 42 as seen in FIG. 7. When mounted to a flat wall 40, as shown in FIG. 6, a disk-like part 44 is situated at the end of each bracket 35. Part 44 is designed to adhere to a flat wall, such as by adhesive or to attach by screws. Alternately, an enlarged part 46 on the end of each bracket 35 can be used to engage the slot 48 in a slot wall, as shown in FIG. 7.

While only a limited number of preferred embodiments of the present invention have been disclosed for purposes of illustration, it should be obvious that many modifications and variations could be made thereto. It is intended to cover all of these modifications and variations which fall within the scope of the present invention, as defined by the following claims:

I claim:

1. A clip for displaying eyeglasses, the eyeglasses being of the type having lens holding frame sections connected by a bridge and first and second hingeably mounted temple pieces, said clip comprising first and second members, each of said members defining a channel for receiving a different one of the temple pieces of the eyeglasses, means for supporting the bridge of the eyeglasses, a wall, said bridge supporting means comprising first and second elements extending outwardly from said wall, said first and second elements being inclined relative to each other.

2. The clip of claim 1 wherein said first and second members extend outwardly from spaced locations on said wall.

3. The clip of claim 1 wherein said bridge supporting means further comprises a third element mounted to said first and second elements.

4. The clip of claim 3 wherein said third element is substantially parallel to said wall.

5. The clip of claim 1 for use with a rod, wherein said clip further comprises rod engaging means.

6. The clip of claim 5 wherein said rod engaging means comprises a channel defined in part by said first and second members.

7. The clip of claim 5 further comprising a base for the said rod.

8. The clip of claim 5 further comprising means for mounting said rod to a wall.

9. The clip of claim 8 wherein said mounting means comprises means for engaging the flat surface of a wall.

10. The clip of claim 5 for use with a slotted wall further comprising means for engaging a slot in the wall.

11. The clip of claim 10 wherein said slot engaging means comprises a bracket and an enlarged part connected to said bracket.

12. The clip of claim 5 wherein the clip is adapted to engage said rod in two different orientations.

13. The clip of claim 1 wherein said members are substantially semi-cylindrical in shape.

14. The clip of claim 1 wherein each of said channels is defined, in part, by a wall and wherein said walls of said channels are substantially parallel to each other.

15. The clip of claim 1 wherein said members are tapered.

16. The clip of claim 1 wherein each of said channels is defined, in part, by a wall and wherein said walls of said channels are inclined toward each other.

17. The clip of claim 1 further comprising a cube-like part situated between said first and second elements.

18. An eyeglass display clip comprising a wall having first and second sides, first and second hollow members extending outwardly at spaced points from said first side, said first and second members each defining a channel therein, said first and second members defining, in part, a recess therebetween, and first and second elements extending outwardly from said second wall side, said first and second elements being inclined relative to each other, such that the eyeglasses could be supported by inserting the temple pieces into the hollow members or by positioning the bridge of the eyeglasses on the first and second elements.

19. The clip of claim 18 further comprising a third element, mounted on said first and second elements, spaced from but generally parallel to said second wall side.

20. The clip of claim 18 wherein said third element has a generally trapezoidal shape.

21. The clip of claim 18 for use with a rod adapted to be received in said recess.

22. The clip of claim 21 further comprising a base for said rod.

23. The clip of claim 21 further comprising means for mounting said rod to the flat surface of a wall.

24. The clip of claim 21 further comprising means for mounting said rod to a wall with a slot.

25. The clip of claim 18 wherein said members are substantially semi-cylindrical in shape.

26. The clip of claim 18 wherein each of said channels comprises, in part, a wall and wherein said walls of said channels are substantially parallel to each other.

27. The clip of claim 18 wherein members are tapered.

28. The clip of claim 18 wherein each of said channels comprises, in part, a wall and wherein said walls of said channels are inclined toward each other.

29. A clip for displaying eyeglasses, the eyeglasses being of the type having lens holding frame sections connected by a bridge and first and second hingeably mounted temple pieces, said clip comprising first and second members, each of said members defining a channel for receiving a different one of the temple pieces, means for supporting the bridge of the eyeglasses, a wall having first and second substantially oppositely facing sides, said first and second members extending from said first wall side and said bridge supporting means extending from said second wall side.

30. The clip of claim 29 wherein said bridge supporting means further comprises a third element mounted on said first and second elements and spaced from said second wall side.

31. The clip of claim 30 wherein said third element is substantially parallel to said second wall side.

32. The clip of claim 30 wherein said third element is substantially trapezoidal in shape.

* * * * *